US006974503B2

(12) United States Patent
Byrnes et al.

(10) Patent No.: US 6,974,503 B2
(45) Date of Patent: Dec. 13, 2005

(54) METHODS AND APPARATUS FOR CONSTRUCTING GAS TURBINE ENGINES

(75) Inventors: Brett Wayne Byrnes, Tijeras, NM (US); Diane K. Norris, Tijeras, NM (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/629,977

(22) Filed: Jul. 30, 2003

(65) Prior Publication Data

US 2005/0025899 A1 Feb. 3, 2005

(51) Int. Cl.[7] ..... B05C 13/02
(52) U.S. Cl. ..... 118/500; 118/504
(58) Field of Search ..... 118/500, 728, 720, 118/721, 504; 29/889.1, 889.6

(56) References Cited

U.S. PATENT DOCUMENTS

| | | | | |
|---|---|---|---|---|
| 5,196,062 | A * | 3/1993 | Bergmann et al. | 118/69 |
| 6,082,291 | A * | 7/2000 | Ittleson et al. | 118/500 |
| 6,224,673 | B1 | 5/2001 | Das et al. | |
| 6,233,822 | B1 | 5/2001 | Grossklaus, Jr. et al. | |

* cited by examiner

*Primary Examiner*—Laura Edwards
(74) *Attorney, Agent, or Firm*—William Scott Andes; Armstrong Teasdale LLP

(57) ABSTRACT

A method for coating a shroud assembly is provided that includes inserting the shroud segment into a clamping fixture such that at least two edges of the shroud are masked by the clamping fixture, mounting the clamping fixture into a spraying fixture such that the shroud segment is oriented in approximately the same orientation as a sprayer, and moving the sprayer and the spraying fixture relative to each other at predetermined rates apply a layer of coating to the shroud segment.

14 Claims, 5 Drawing Sheets

METHODS AND APPARATUS FOR CONSTRUCTING GAS TURBINE ENGINES

BACKGROUND OF THE INVENTION

This invention relates generally to gas turbine engines, and more specifically to turbine shroud assemblies used in gas turbine engines.

Gas turbine engines generally include, in serial flow arrangement, a high pressure compressor for compressing air flowing through the engine, a combustor in which fuel is mixed with the compressed air and ignited to form a high energy gas stream, and a high pressure turbine. The high pressure compressor, combustor and high pressure turbine are sometimes collectively referred to as the core engine. Such gas turbine engines also may include a low pressure compressor, or booster, for supplying compressed air to the high pressure compressor.

Generally, gas turbine engines operate more efficiently as combustion and exhaust temperatures increase. However, the operating temperature of the combustion gases is normally limited by the materials used to fabricate the hot-section components of the engine, such as the combustor and the turbine. To facilitate operating the engine at a higher operating temperature, at least some known turbine assemblies are coated with a thermal barrier coating (TBC). The TBC facilitates thermally, insulating the components from the combustible gases.

To facilitate maintaining turbine tip clearance, known shroud assemblies are masked prior to applying the TBC. However, masking of shroud segments is a time consuming process that is typically done by hand. Furthermore, during the TBC application process, the tape may blister and deform when exposed to the heat generated during the TBC application process.

BRIEF DESCRIPTION OF THE INVENTION

In one aspect, a method for coating a shroud assembly for a gas turbine engine is provided. The method comprises inserting the shroud segment into a clamping fixture such that at least two edges of the shroud are masked by the clamping fixture, mounting the clamping fixture into a spraying fixture such that the shroud segment is oriented in approximately the same orientation as a sprayer, and moving the sprayer and the spraying fixture relative to each other at predetermined rates to apply a layer of coating to the shroud segment.

In another aspect, an apparatus for clamping and locating shroud segments during a spraying operation is provided. The apparatus includes a base and a pair of elongated arms, each having a first end and a second end. The first ends of the arms are coupled to the base. A clamping element is coupled to the second end of each arm. The clamping elements secure a shroud segment to the base such that at least one edge of the shroud segment is masked by the clamping elements. A locating member is coupled to the base between the pair of arms for positioning the shroud segment with respect to said base. The locating member is configured to engage a shroud segment surface for positioning the shroud segment.

DETAILED DESCRIPTION OF THE INVENTION

Figure 1:
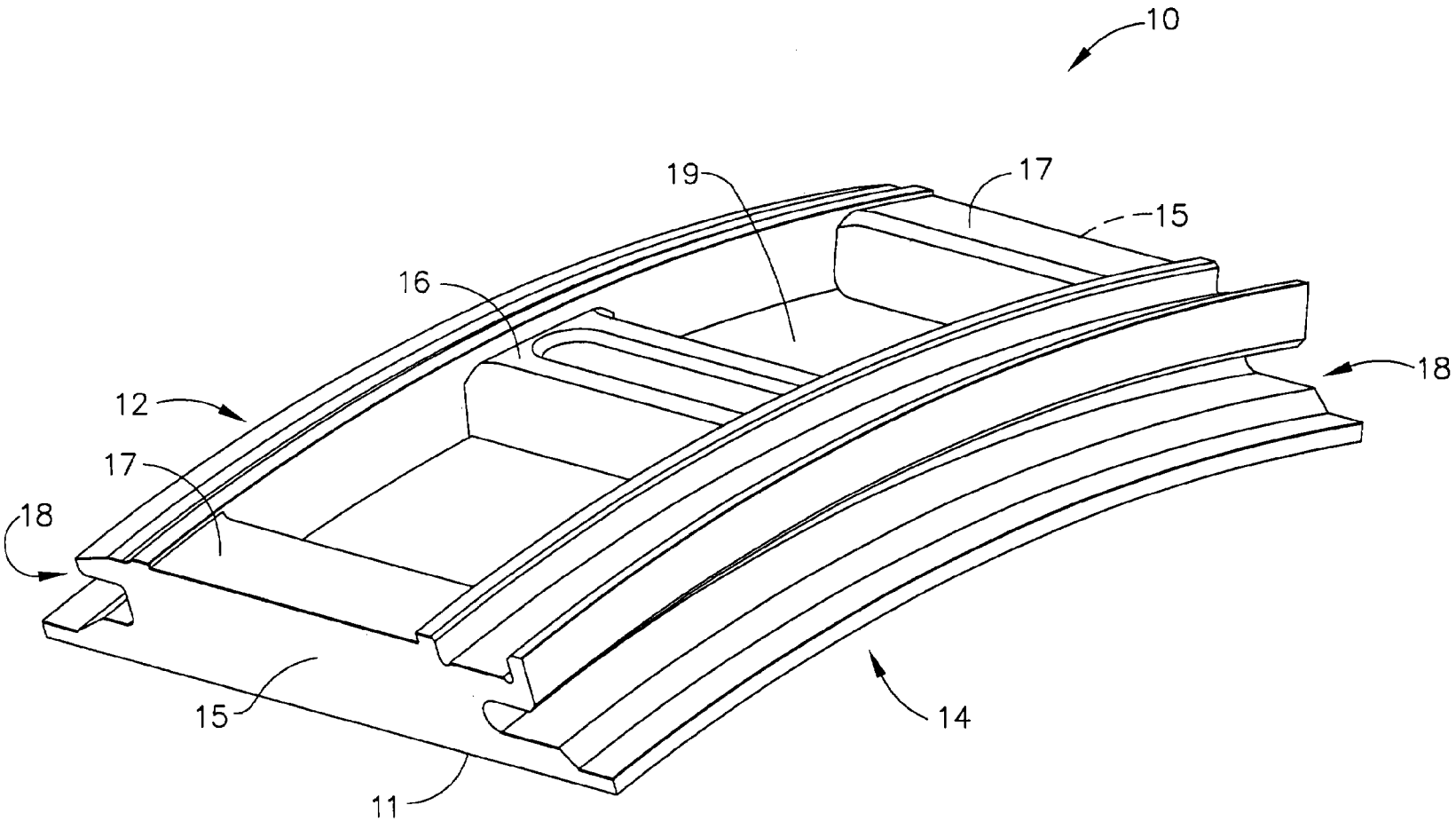
FIG. 1 is a perspective view of an exemplary shroud segment for a gas turbine engine.

FIG. 1 is a perspective view of an exemplary shroud segment 10. Shroud segment 10 is used in a turbine section of a gas turbine engine (not shown). Shroud segment 10 includes a radially inner side 11 and an opposite radially outer side 19. Outer side 19 includes a center rib 16, and a pair of end ribs 17 that are each positioned at opposite circumferential outer edges 15 of shroud segment 10. Shroud segment 10 also includes a leading edge side 12 and an opposite trailing edge side 14. Leading and trailing edge sides 12 and 14, respectively, include mounting channels 18 formed therein.

Prior to the application of a thermal barrier coating (TBC) material, shroud 10 is masked to facilitate ensuring that TBC material is only applied to desired locations. Specifically, masking is applied to leading and trailing edge sides 12 and 14 respectively, and also to and mounting channels 18 during the coating process. More specifically, the masking facilitates preventing the coating materials, which include a base coat and a ceramic upper layer, from contacting the mounting channels 18 of shrouds 10.

Figure 2:
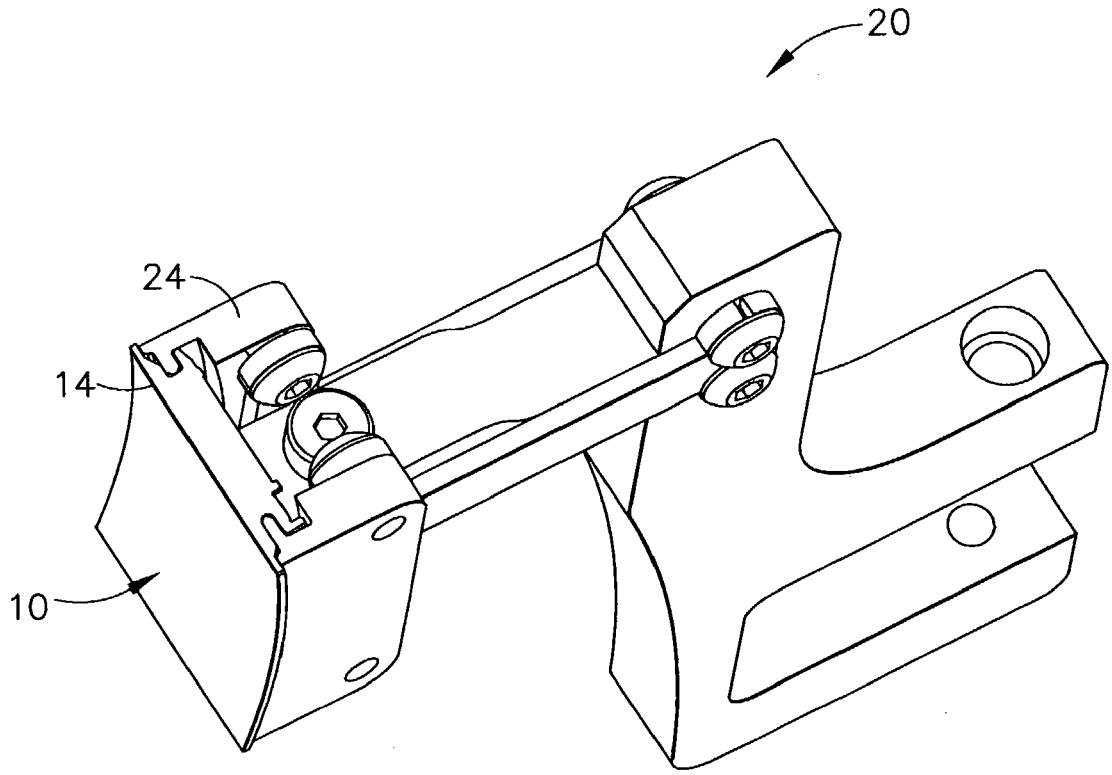
FIG. 2 is a perspective view of a shroud clamp and location fixture with a shroud segment inserted therein.
Figure 3:
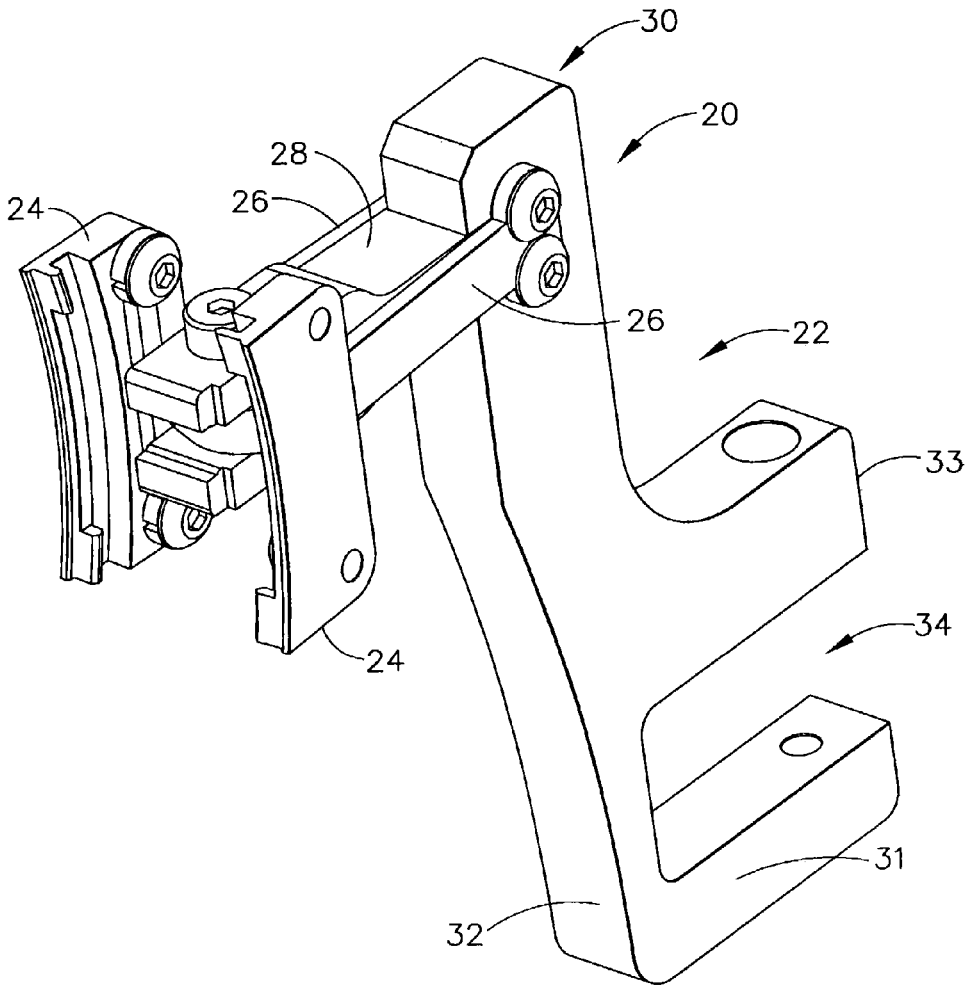
FIG. 3 is an alternative perspective view of the shroud clamp and locating fixture shown in FIG. 2.
Figure 4:
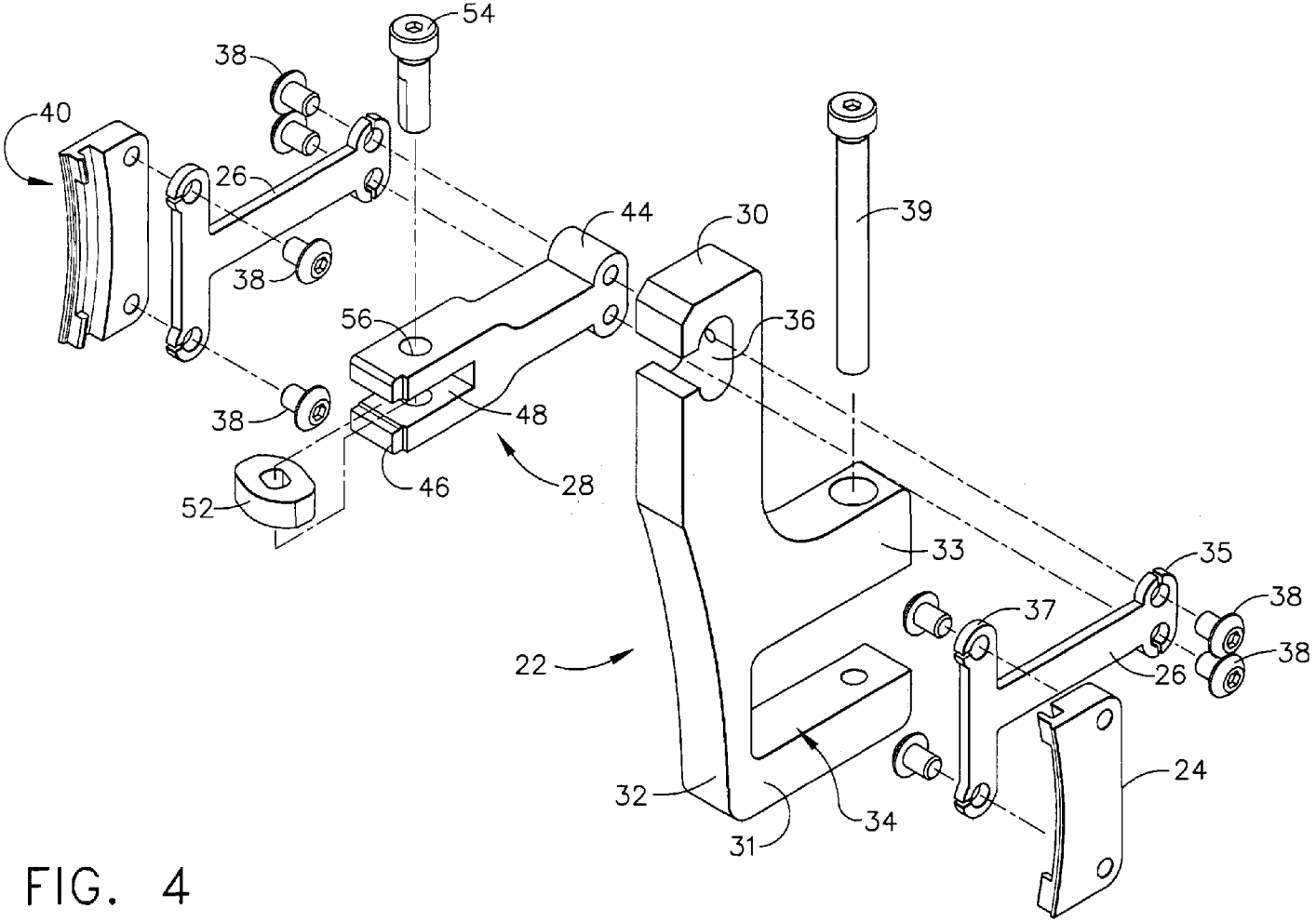
FIG. 4 is an exploded view of the shroud clamp and locating fixture shown in FIG. 3.

FIG. 2 is a perspective view of a shroud clamp and location fixture 20 with a shroud segment 10 inserted therein. FIG. 3 is an alternative perspective view of shroud clamp and locating fixture 20. FIG. 4 is an exploded view of shroud clamp and locating fixture 20.

Shroud clamp and locating fixture 20, as described in more detail below, receives a shroud segment 10 between clamping elements 24, to facilitate preventing coating material from contacting leading and trailing edge sides 12 and 14, respectively during a coating process. In one embodiment, the coating applied is a thermal barrier coating, TBC.

Fixture 20 includes a base 22, a pair of shroud clamping elements 24, a pair of arms 26, and a locating member 28. Base 22 includes an upper body portion 30 and a lower body portion 32. Lower body portion 32 includes a slot 34 defined therein that extends between a pair of mounting arms 31 and 33. Slot 34 facilitates coupling fixture 20 to a spraying fixture (not shown in FIGS. 2–4) with a fastener 39. Upper body portion 30 includes a slot 36 defined therein that is sized to receive at least a portion of locating member 28 therein.

Each arm 26 includes a first end 35 used to couple each arm 26 to base 22, and a second end 37. Clamping elements 24 are coupled to each arm second end 37 using fasteners 38. Spacers (not shown in FIGS. 2–4) may be inserted between clamping elements 24 and arm second end 37 to facilitate accommodating shroud segments of varying widths. At least one of arms 26 is deflectable from a first position wherein shroud segment 10 is held between clamping elements 24, to a second position wherein shroud segment 10 is released from clamping elements 24. More specifically, the deflectable arm 26 is biased towards the first-position such that shroud segment 10 is retained by clamping elements 24. In one embodiment, at least one of arms 26 is a leaf spring.

Clamping elements 24 each include a shroud mating face 40 that is contoured substantially complementary to shroud leading and trailing edge sides 12 and 14 respectively. In one embodiment, mating face 40 is machined to form the contour. More specifically, thus, clamping elements 24 contact shroud leading and trailing edge sides 12 and 14 in sealing contact to facilitate prohibiting the application of coating materials against sides 12 and 14, as described in more detail below.

Locating member 28 includes a mounting end 44 that is used to couple locating member 28 to base 22, and a shroud engagement end 46. Shroud engagement end 46 includes a slot 48 defined therein that receives at least a portion of shroud center rib 16 to facilitate aligning shroud 10 within fixture 20. In one embodiment, locating member 28 is yoke-shaped. Locating member 28 also includes a cam 52 that is positioned within slot 48. A cam adjuster 54 extends through an opening 56 formed in locating member 28 and is coupled to cam 52. In one embodiment, cam adjuster 54 is keyed to cam 52. Cam 52 spreads arms 26 apart to permit the insertion and removal of shroud segment 10. More specifically, cam adjuster 54 moves arms 26 from a first position, wherein shroud segment 10 is retained by clamping elements 24, to a second position wherein shroud segment 10 is removable from clamping elements 24.

In operation, deflectable arm 26 is initially biased towards the first position such that shroud segment 10 is retained with in fixture 20 by clamping elements 24. In order to insert shroud segment 10, cam adjuster 54 is rotated, causing cam 52 to spread arms 26 apart. Shroud segment 10 is then inserted between clamping elements 24 such that center rib 16 is positioned within slot 48 on locating member 28. Accordingly, shroud segment 10 is facilitated to be aligned with respect to fixture 20. Shroud 10 leading and trailing edge sides 12 and 14 are then aligned using mating faces 40 of clamping elements 24, and cam adjuster 54 is operated to enable arms 26 to return to their original biased position such that shroud 10 is retained between clamping elements 24. More specifically, cam adjuster 54 is rotated causing cam 52 to spread arms 26 apart. Shroud segment 10 is inserted between clamping elements 24 such that mating faces 40 seal sides 12 and 14 to facilitate prohibiting the application of coating materials against sides 12 and 14.

As shroud segment 10 is being held in clamp and locating fixture 20, thermal barrier coatings can be applied without entry of the coating material into leading and trailing edge sides 12 and 14. Shroud clamp and locating fixture 20 facilitates the application of a uniform coating to shroud segment 10. In order to facilitate maintaining turbine blade to shroud clearances in the gas turbine engine, all of the shroud segments in a shroud assembly are coated at the same time with each shroud segment 10 held in one shroud clam and locating fixture 20.

Figure 5:
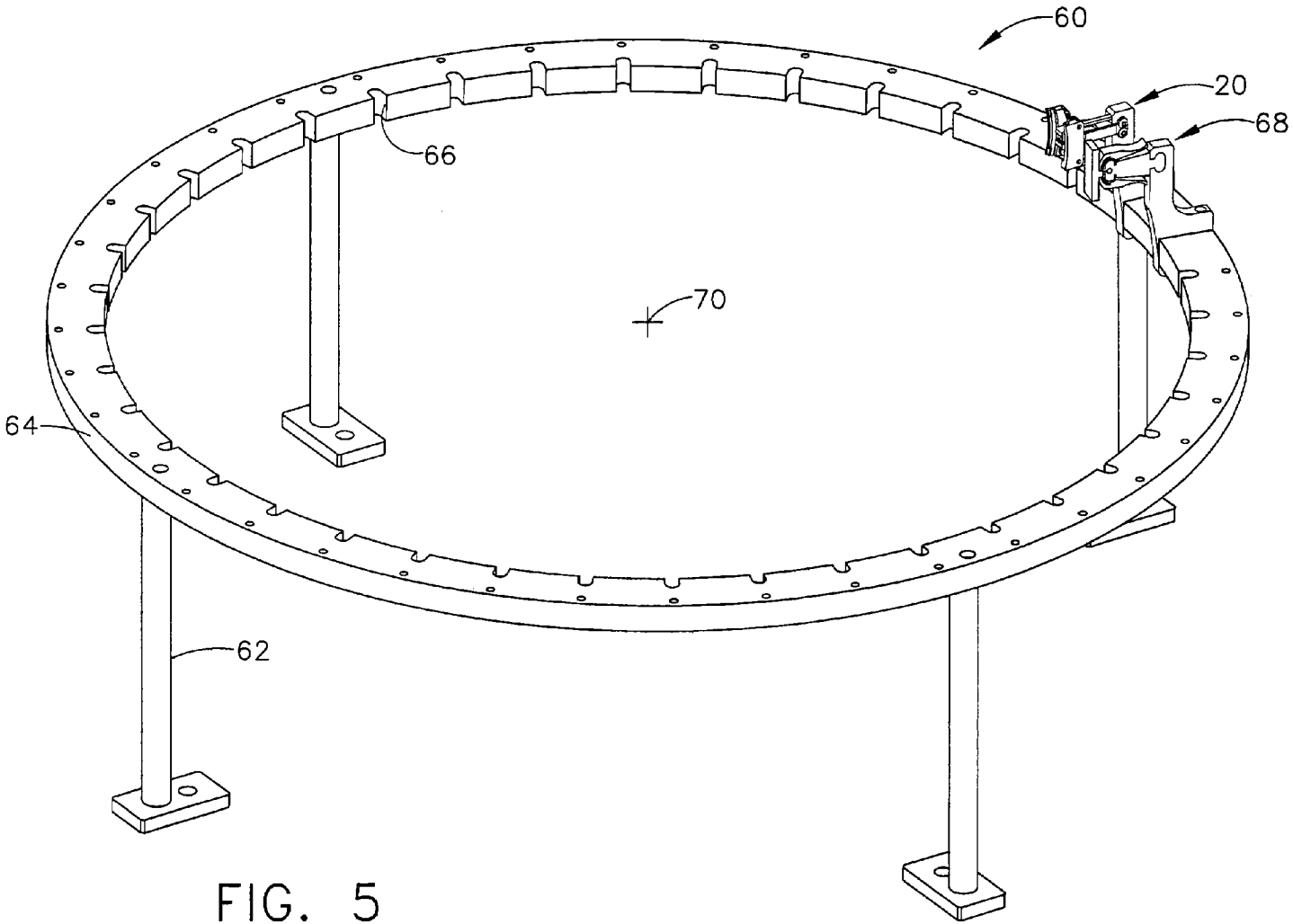
FIG. 5 is a perspective view of an exemplary spraying fixture for use with the shroud clamp and locating fixture shown in FIG. 4.

FIG. 5 illustrates an exemplary spraying fixture 60 that may be used to apply ceramic coatings. Spraying fixture 60 includes supports 62 and an annular ring 64 that includes a plurality of shroud mounting stations 66 that extend circumferentially around an inner perimeter of Ring 64. One or more mounting stations may be used as a test station 68 on ring 64. Spraying fixture 60 is mounted on a rotating table (not shown). During a spraying process, spraying fixture 60 is rotated around a sprayer (not shown) that is positioned in a geometric center 70 of ring 64 when the spraying process is performed.

In operation, shroud segments 10 are individually placed in a clamp and locating fixture 20. With the fixture 20, masking, with tape, of shroud 10 is not necessary. The holding face 40 of clamping elements 24 seals leading and trailing edge sides 12 and 14 of shroud 10 so that sides 12 and 14 are masked by the clamping elements 24. It is to be noted, however, that when installed in fixture 20, shroud ends 15 are exposed to overspray. This is if little consequence because a final machining operation is performed on shroud ends 15 after the coating process. Locating member 28 facilitates the uniform positioning of shroud segments 10 in their respective fixture 20. When the shroud segments 10 are mounted in fixture 20, fixtures 20 are then mounted in spraying fixture 60 by placing each fixture 20 in a shroud mounting station 66 of spray fixture ring 64. In one embodiment, 42 shroud segments are mounted in spray fixture ring 64. When shrouds 10 and shroud fixtures 20 are mounted in spray fixture ring 64, final adjustments are made to shroud fixtures 20 so that each shroud segment 10 is the same distance from the sprayer and the same height relative to the sprayer. The sprayer, which is positioned at geometric center 70 of spray fixture ring 64 oscillates up and down while spraying fixture 60 is rotated around the sprayer. In this manner, a thin even coating of material is applied to each shroud segment 10. The coating is applied in thin layers over several revolutions of spraying fixture 60. In one embodiment, 128 revolutions of the spraying fixture is made to achieve the desired coating thickness. Test stations 68 are provided on ring 64 to verify the results of the coating process.

The above described shroud segment clamping and locating fixture provides a cost effective and highly reliable apparatus for the masking and coating of shroud segments. The fixture facilitates eliminating failures due to blistering and deformation of the masking tape due to the heat of the spraying process and eliminates the cost of rework and repair. The cost of the masking tape is also eliminated.

Exemplary embodiments of a shroud clamp and locating apparatus are described above in detail. The shroud clamp and locating assemblies are not limited to the specific embodiments described herein, but rather each component may be utilized independently and separately from other components described herein. Each component can also be used in combination with other shroud clamp and locating components.

While the invention has been described in terms of various specific embodiments, those skilled in the art will recognize that the invention can be practiced with modification within the spirit and scope of the claims.

What is claimed is:

1. An apparatus for clamping and locating shroud segments during a spraying operation, said apparatus comprising:

a base;

a pair of elongated arms, each comprising a first end and an opposite second end, each of said first ends coupled to said base;

a clamping element coupled to each said arm second end, said clamping element for securing a shroud segment to said base, such that at least one edge of the shroud segment is positioned against and masked by said clamping element; and a locating member comprising a yoke defining a slotted opening sized to receive a locating rib extending from the shroud segment, said locating member is coupled to said base between said pair of arms for positioning the shroud segment with respect to said base, said locating member configured to engage a shroud segment surface for positioning the shroud segment.

2. An apparatus in accordance with claim 1 wherein at least one of said arms is deflectable transversely relative to a length of said arm.

3. An apparatus in accordance with claim 1 wherein at least one of said arms is fabricated from spring steel.

4. An apparatus in accordance with claim 1 wherein at least one of said arms is deflectable between a first position wherein the shroud segment is held by said clamping element and a second position wherein the shroud segment is released from said clamping element.

5. An apparatus in accordance with claim 4 wherein said at least one arm is biased toward said first position.

6. An apparatus in accordance with claim 1 further comprising a cam positioned within said yoke slotted opening, said cam for moving said deflectable arm between a first position wherein the shroud segment is held by said clamping element and a second position wherein the shroud segment is released from said clamping element.

7. An apparatus in accordance with claim 6 further comprising an adjuster coupled to said cam for controlling operation of said cam.

8. An apparatus for clamping gas turbine engine shroud segments, said apparatus comprising:

a base;

a pair of arms comprising opposite first and second ends, each of said first ends coupled to said base;

a clamping element coupled to each said arm second end, said clamping element configured to clamp the shroud segments to said base such that at least one edge of each shroud segment is positioned against and masked by said clamping element; and a locating member comprising a yoke comprising a slotted opening defined therein, said opening sized to receive at least a portion of the shroud segment therein.

9. An apparatus in accordance with claim 8 wherein at least one of said arms is deflectable transversely relative to a length of said arm.

10. An apparatus in accordance with claim 8 wherein at least one of said arms is fabricated from spring steel.

11. An apparatus in accordance with claim 8 wherein at least one of said arms is deflectable between a first position wherein the shroud segment is held by said clamping element and a second position wherein the shroud segment is released from said clamping element.

12. An apparatus in accordance with claim 11 wherein said at least one arm is biased toward said first position.

13. An apparatus in accordance with claim 8 wherein said locating member is coupled to said base between said pair of arms for positioning the shroud segment with respect to said base.

14. An apparatus in accordance with claim 13 wherein said locating member yoke opening is sized to receive a locating rib extending from the shroud segment.

* * * * *